US007753100B2

(12) United States Patent
Luomanen et al.

(10) Patent No.: US 7,753,100 B2
(45) Date of Patent: Jul. 13, 2010

(54) PARTITION WITH VARIABLE-ANGLE TILES

(75) Inventors: Christopher A. Luomanen, San Francisco, CA (US); Michael J. Udulutch, Minneapolis, MN (US)

(73) Assignee: 3form, Inc., Salt Lake City, UT (US)

( * ) Notice: Subject to any disclaimer, the term of this patent is extended or adjusted under 35 U.S.C. 154(b) by 0 days.

(21) Appl. No.: 11/994,473

(22) PCT Filed: Dec. 14, 2007

(86) PCT No.: PCT/US2007/087641

§ 371 (c)(1),
(2), (4) Date: Jan. 2, 2008

(87) PCT Pub. No.: WO2008/076923

PCT Pub. Date: Jun. 26, 2008

(65) Prior Publication Data

US 2010/0101738 A1 Apr. 29, 2010

Related U.S. Application Data

(60) Provisional application No. 60/869,996, filed on Dec. 14, 2006.

(51) Int. Cl.
*E06B 9/00* (2006.01)

(52) U.S. Cl. ..... 160/218; 160/220; 160/332; 160/199

(58) Field of Classification Search ..... 160/184, 160/130, 218, 220, 332, 135, 199; D6/575; D25/160

See application file for complete search history.

(56) References Cited

U.S. PATENT DOCUMENTS

| | | | | | |
|---|---|---|---|---|---|
| 1,487,794 | A | * | 3/1924 | Melaun | 160/332 |
| 2,917,188 | A | * | 12/1959 | Menin | 211/194 |
| 2,970,396 | A | * | 2/1961 | Worrell | 40/605 |
| 2,993,604 | A | * | 7/1961 | Sullivan | 211/169 |
| 3,456,711 | A | * | 7/1969 | Spencer | 160/332 |
| 3,654,982 | A | * | 4/1972 | Labelle | 160/199 |
| D422,797 | S | * | 4/2000 | Vincent | D6/332 |
| D509,573 | S | * | 9/2005 | Reid et al. | D23/293.1 |

OTHER PUBLICATIONS

Patent Cooperation Treaty international preliminary report on patentability mailed Jun. 25, 2009, International application No. PCT/US2007/087641.

* cited by examiner

*Primary Examiner*—Blair M. Johnson
(74) *Attorney, Agent, or Firm*—Workman Nydegger

(57) ABSTRACT

A variable-angle tile partition comprises tiles of any shape, material, color, or degree of translucence. In one implementation, the tile partition is constructed with a first row of decorative tiles joined to a second row of tiles using a left or right-angled tile connector. In at least one implementation, the tile partition can further include a third row of tiles joined to the second row of tiles, typically using the other of the left or right-angled tile connector. A manufacturer can continually join each next row of decorative tiles with alternating left or right-handed tile connectors. The unique tying/joining together of tile rows using left or right-angled tile connectors at least partly allows the variable partition to partition constrained spaces in a uniform and variable manner, which can be used to diffuse light or sound, or otherwise provide various aesthetic and structural needs.

20 Claims, 7 Drawing Sheets

PARTITION WITH VARIABLE-ANGLE TILES

CROSS-REFERENCE TO RELATED APPLICATIONS

The present invention is a U.S. National Stage Application corresponding to PCT Application No. PCT/US07/87641, filed on Dec. 14, 2007, entitled "PARTITION WITH VARIABLE-ANGLE TILES," which claims the benefit of U.S. Provisional Patent Application No. 60/869,996, filed on Dec. 14, 2006, entitled "TILE CURTAIN." The entire contents of each of the aforementioned applications is incorporated herein by reference.

BACKGROUND OF THE INVENTION

1. The Field of the Invention

This invention relates to systems, methods and apparatus for partitioning spaces with tiles, or otherwise treating existing structures with tiles.

2. Background and Relevant Art

The fields related to architectural design typically involve creative application of materials and structures in a given space with both aesthetic and functional considerations. In this regard, one particular area of interest in architectural design relates to partitioning spaces, such as materials and apparatus for use as one or more wall, ceiling, or floor structures, and/or treatments regarding the same. Often, the considerations made in partitioning or decorating a given space depend on the available materials, and associated costs. For example, conventional building materials used in structural partitions or treatments include drywall, fabrics, metals, wood, glass, and/or various masonry.

Recent developments in architectural design, however, now include the use of resin materials as building materials. Some common resin materials used as building materials now include materials such as acrylonitrile butadiene styrene or "ABS", polyvinyl chloride or "PVC"; polyacrylate materials such as poly(methyl methacrylate) or "PMMA" (also known as acrylic); polyester or copolyester based materials such as poly(ethylene terephthalate), "PET," either modified or unmodified with 1 to 99 mole percent of a diol or combination of diols, such as ethylene glycol, neopentyl glycol or cyclohexanedimethanol, or "PETG" and "PCTG"; as well as polycarbonate resin based materials, acrylic, and any combinations thereof.

In general, resin materials can provide a number of advantages over conventional building materials such as drywall, glass, etc. in terms of cost (e.g., compared with glass) as well as formability and reuse. At the outset, for example, resin materials tend to be far less expensive in most applications than materials such as glass or the like, where certain structural, optical, and aesthetic characteristics are desired. In addition, resin materials tend to be far more flexible in terms of manufacture and assembly, since resin materials can also be bent, molded, colored, shaped, cut and modified many different ways, and still reused in place of conventional materials at a later point much more easily than conventional counterparts.

Notwithstanding such advantages, however, designers have in the past tended to use resin materials primarily as decorative replacements for conventional structures such as doors, panels, or windows. For example, rather than using a metal or wooden door, the designer might implement a resin panel door in place thereof, or might even implement a resin treatment to the door. In other cases, the designer might replace a given window with a resin panel that includes one or more decorative objects. In cases where a rigid structure may be less useful, however, such as with a curtain or accordion-style partition, resin materials have not typically been used as replacement materials. This may be because resin materials in the architectural design fields tend to be manufactured and implemented primarily as large, rigid panels, which may not be readily suited for such flexible partitioning.

Nevertheless, flexible partitioning such as this is becoming more important, particularly in many newer designs where space considerations are a premium. (In some such spaces, even slidable panels may be too inflexible and space consuming, whether for receiving the given panels from one area to the next, or potentially due to the room taken up by the ceiling and/or floor track hardware.) Despite this increased importance, there has been little change in design of such collapsible/variable partitions, as well as change in materials using such partitions. Rather, collapsible or variable partitions tend to rely on conventional curtains or accordion-style partitions, which, in turn, rely on textile-based materials, or materials/structures that have not heretofore lent themselves to using decorative resin-based materials.

In addition, such collapsible/variable structures tend to provide an all or nothing approach in terms of partitioning a space for light and sound. There are other types of variable partitions that might variably allow some pass through of light and/or sound without having to be removed, such as hanging blinds that are rotated in one direction or another, or even hanging materials such as beads. Structures such as these, however, tend to be either too freely rotatable along a vertical line of components/materials, or constrained so that each line of component/material rotates in precisely the same alignment as all of the other vertical lines of component/material in the partition. Thus, such structures tend to be either too variable, or not variable enough for a wide range of decorative and/or structural applications.

Accordingly, there are a number of disadvantages in present partitions that can be addressed, particularly where the needs for both variability and uniformity in presentation and function may be desired at the same time as dealing with a constrained space.

BRIEF SUMMARY OF THE INVENTION

Implementations of the present invention provide systems, methods, and apparatus configured to partition a space, or otherwise provide a treatment to a structure, such as a window, ceiling, floor, or wall structure. In one implementation, a tile partition, also referred to as a tile curtain, comprises sets of tiles joined vertically in a staggered row formation, with half-tiles positioned at extreme horizontal edges of every other row. In one implementation, such a configuration allows tiles in the tile partition to be positioned with a flat interface, or angled and/or compressed in a uniform manner, simply by aligning one of the tiles in the partition.

For example, a decorative partition with variable tiles in accordance with an implementation of the present invention can include a plurality of tiles aligned in a plurality of different tile rows, where each tile in each row of tiles is connected by a plurality of tile connectors to one or more tiles in a next adjacent tile row above or below. In this partition, the tiles in each tile row of the plurality of tile rows are generally configured to rotate in the same direction upon rotation of any particular tile in the tile row. In addition, the tiles in the next adjacent tile row above or below are generally configured to rotate in an opposing direction upon rotation of the particular tile in the tile row that is above or below.

In addition, another decorative partition with variable-angle tiles in accordance with an implementation of the present invention can include a row of decorative tiles of one or more shapes. The partition can also include an adjacent row of decorative tiles of one or more shapes, where the adjacent row of decorative tiles are connected to the row of decorative tiles with a set of rotatable tile connectors. In addition, the partition can include a next row of decorative tiles of one or more shapes, where the next row of decorative tiles are connected to the adjacent row of decorative tiles with a set of rotatable tile connectors. In this partition, each tile is connected either directly or indirectly to each other tile in the partition, so that rotation of any tile in the partition causes at least some of the tiles to rotate in one direction, and the remainder of the tiles to rotate in an opposing direction.

Furthermore, a method of providing a variable barrier or partition to an interior space with variable light or sound diffusion characteristics can include aligning a plurality of tiles in a tile row. The method can also include vertically connecting a plurality of tiles in a next row to the tile row with at least two tile connectors per tile on one of a facing or rearward side. In addition, the method can include vertically connecting a plurality of tiles in a further row to the next row with at least two tile connectors per tile on the other of the facing or rearward sides. Furthermore, the method can include aligning one of the plurality of tiles in any of the tile rows by an amount in a direction, where at least some of the tiles in the partition automatically change direction in the direction, while the rest of the tiles rotate in an opposing direction proportional to the amount.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 2C1-2 illustrate alternating facing and side views of an upper connector element used in either the left or right-handed connector of FIG. 2A or 2B;

FIG. 2D1-2 illustrate alternating facing and side views of a lower connector element used in either the left or right-handed connector of FIG. 2A or 2B;

DETAILED DESCRIPTION OF THE PREFERRED EMBODIMENTS

The present invention extends to systems, methods, and apparatus configured to partition a space, or otherwise provide a treatment to a structure, such as a window, ceiling, floor, or wall structure. In one implementation, a tile partition, also referred to as a tile curtain, comprises sets of tiles joined vertically in a staggered row formation, with half-tiles positioned at extreme horizontal edges of every other row. In one implementation, such a configuration allows tiles in the tile partition to be positioned with a flat interface, or angled and/or compressed in a uniform manner, simply by aligning one of the tiles in the partition.

Accordingly, and as will be understood more fully herein, implementations of the present invention provide a number of benefits for decorative architectural partitions at least in terms of materials, designs, and uses thereof. For example, implementations of the present invention provide a unique partition structure that can highlight the decorative capabilities of certain materials, such as resin materials. In addition, implementations of the present invention provide the ability to variably partition a given space with rigid materials that are uniformly aligned, and that can be sensitive to various space constraints. In particular, the structure can be moved or collapsed without necessarily requiring the partition to be slid/moved along a track from one end to the next. Furthermore, implementations of the present invention provide structures that can be readily altered for various optical and/or sound effects in a given space or set of spaces.

Figure 1:
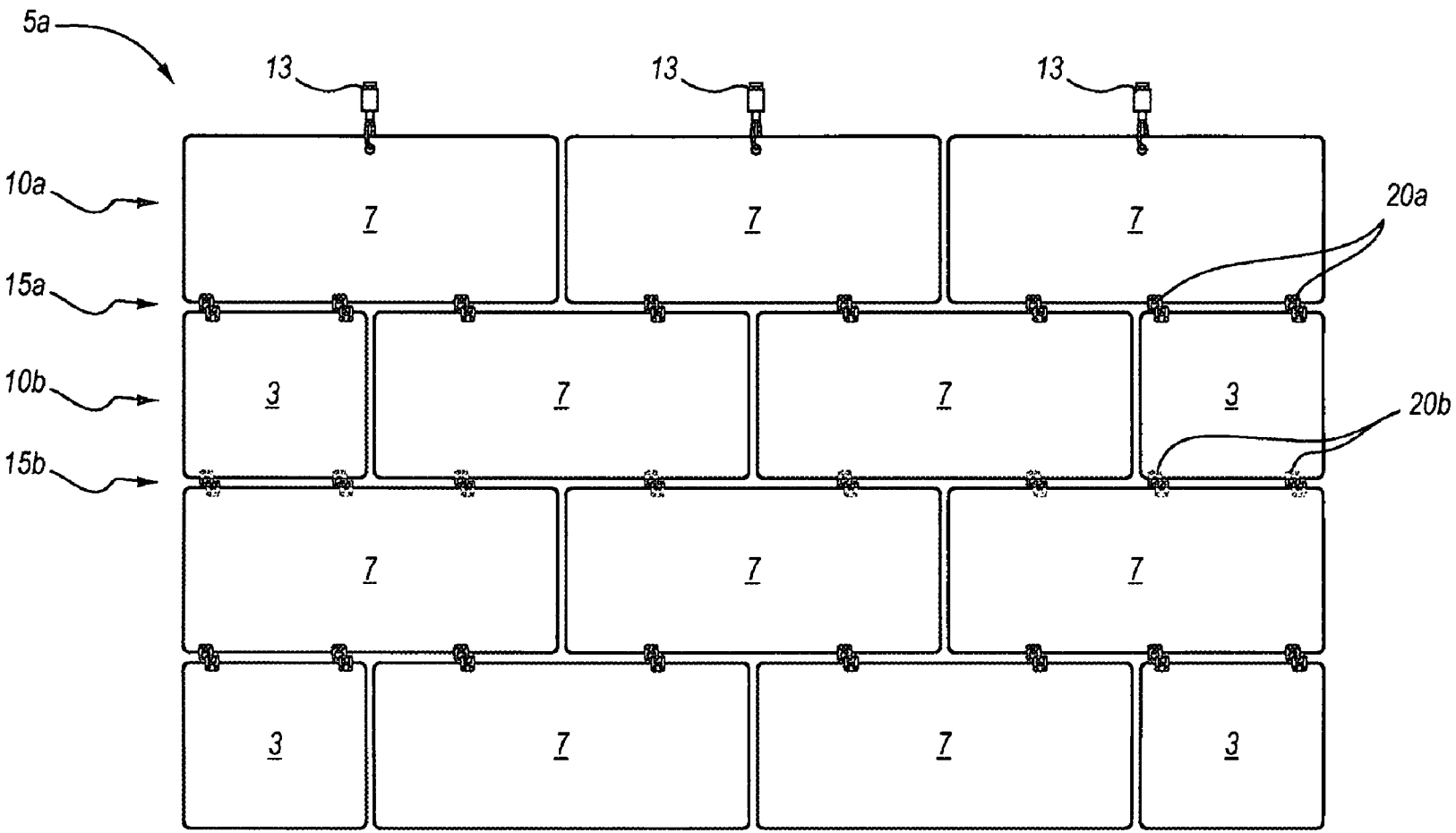
FIG. 1 illustrates a schematic drawing of a variable-angled tile partition in accordance with an implementation of the present invention, where the partition is in a planar configuration.
Figures 2, 2C:
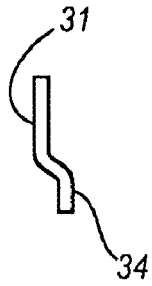
Figure 3A:
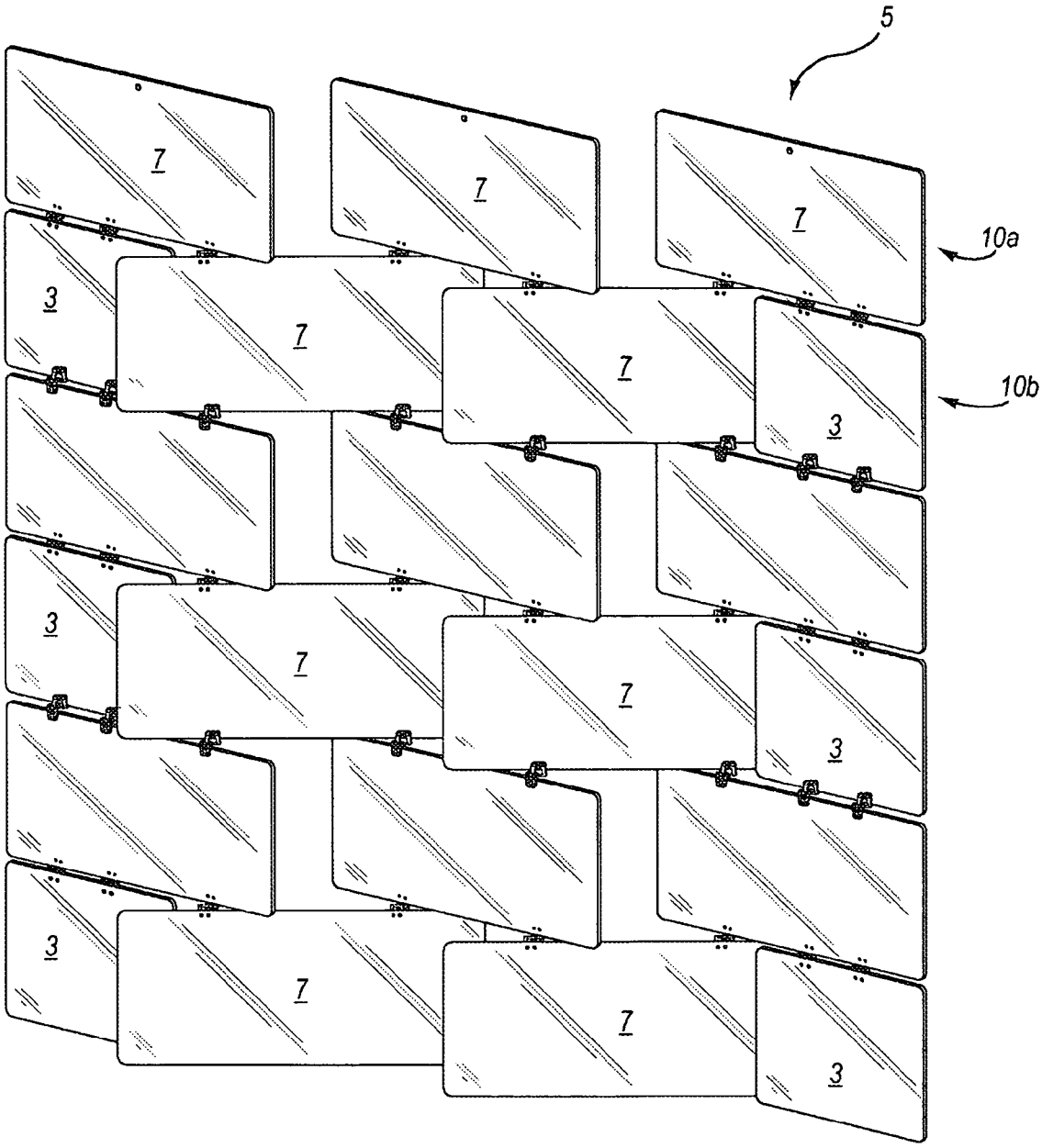
FIG. 3A illustrates a schematic drawing of the partition in FIG. 1 in a partially angled configuration.
Figure 3B:
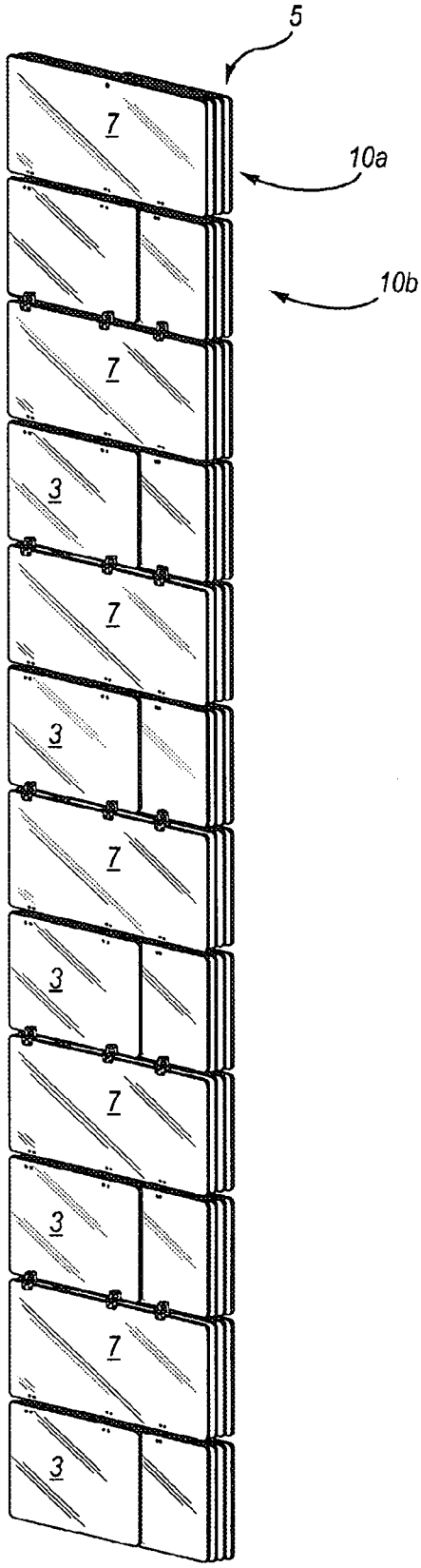
FIG. 3B illustrates a schematic drawing of the partition in FIG. 1 or 3A in a fully collapsed configuration.
Figure 4:
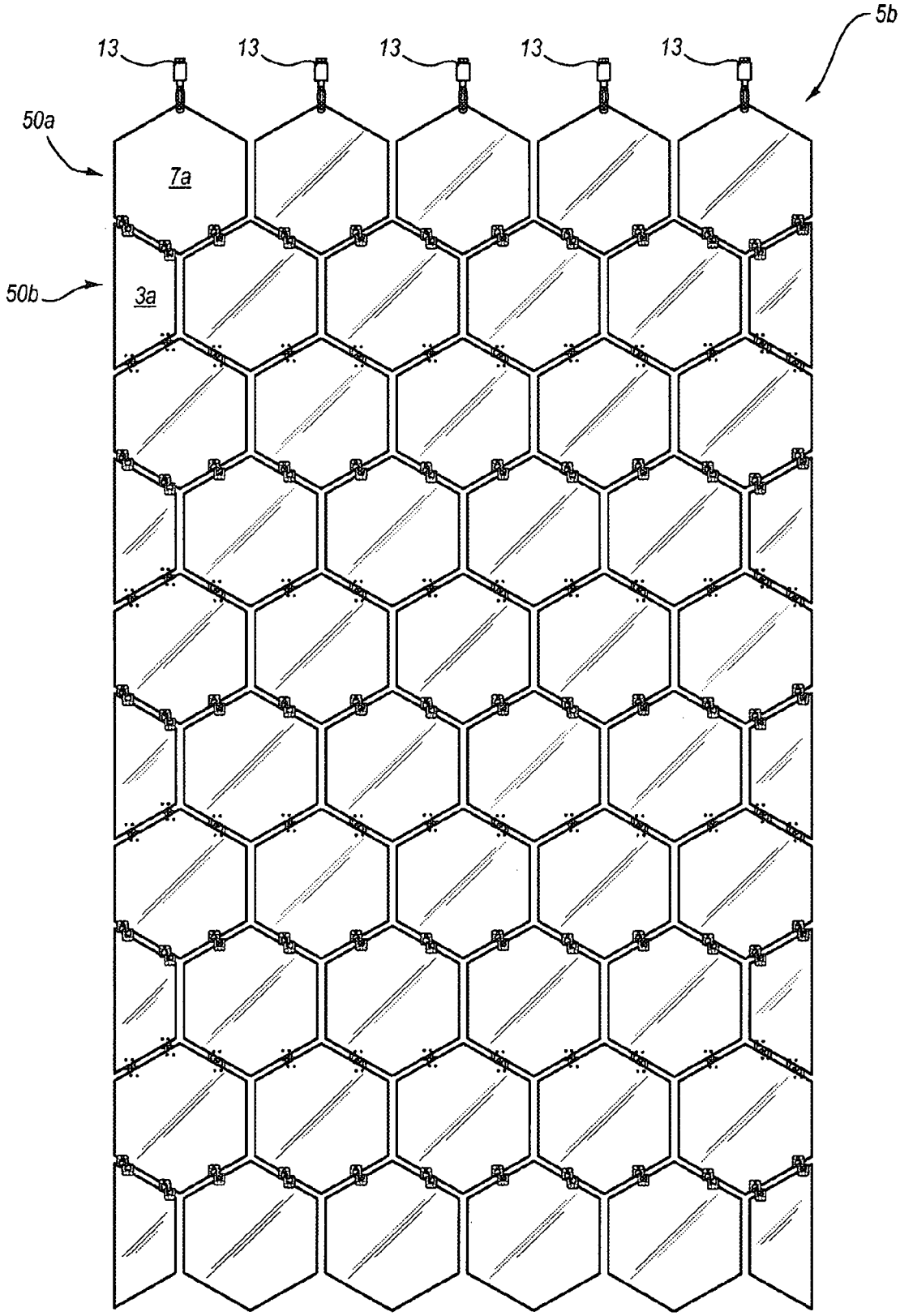
FIG. 4 illustrates a generalized schematic drawing of a partition in accordance with an implementation of the present invention utilizing a different shape of tile, such as a hexagonal shape.

FIGS. 1-5 illustrate various schematics of an inventive variable-angled tile partition (or "tile curtain") and corresponding apparatus, which can be variably aligned with relative ease. In particular, and as will be understood more fully herein, the apparatus of each partition allow the tiles to be variably angled from planar to collapsed configurations, such as may be needed for any number of aesthetic or functional ends. For example, FIG. 1 illustrates an exemplary tile partition/curtain 5*a* in a planar configuration, while FIGS. 3A and 4 show differently angled (or even differently shaped) configurations of a partition 5(*a* or *b*), and FIG. 3B shows a collapsed configuration. The materials, shapes, alignments, and connectors for these partitions are discussed more fully below.

In particular, each exemplary partition can comprise a set of interconnected tiles (e.g., 3, 7), which, in turn, comprise virtually any number or combination of glass, wood, drywall, metal, granite, ceramic materials, and/or resin material. For the purposes of this invention, however, resin materials will be used more commonly, such as resin-based tiles comprising one or more of acrylonitrile butadiene styrene or "ABS", polyvinyl chloride or "PVC"; polyacrylate materials such as poly(methyl methacrylate) or "PMMA" (also known as acrylic); polyester or copolyester based materials such as poly(ethylene terephthalate), "PET," either modified or unmodified with 1 to 99 mole percent of a diol or combination of diols, such as ethylene glycol, neopentyl glycol or cyclohexanedimethanol, or "PETG" and "PCTG"; as well as polycarbonate resin based materials, acrylic, and any combinations thereof.

In addition to the various types of materials used, virtually any shape and configuration of tile 3, 7 can be used within a given partition as long as given tile can fit and rotate within a particular profile (e.g., consistent with the generalized profile of other tiles in the partition). For example, FIGS. 1 and 3A-3B illustrate a partition 5*a* that incorporates essentially rectangular tiles 3, 7, while FIG. 4 illustrates a partition 5*b* that incorporates essentially hexagonally-shaped tiles 3*a*, 7*a*. Of course, other tile shapes can include circles, ovals, squares, octagons, pentagons, and/or any mixtures thereof. Furthermore, one will appreciate that the tiles described herein can also be varied in terms of color, and/or degree of translucence (which may be particularly applicable when used as a window treatment).

FIGS. 1, 3A-3B, and 4 also show that the tiles 3, 7 of a partition 5 are each positioned in an essentially staggered (e.g., like brick alignments) configuration. For example, FIG. 1 shows the left-most "full-tile" 7 of tile row 10*a* overlaps with left-most "half-tile" 3 (or "partial-tiles" 3) and tile 7 on tile row 10*b*, much like in a staggered brick formation. Similarly, the next-left-most tile 7 on tile row 10*a* overlaps or otherwise connects with two different tiles 7 on tile row 10*b*. As shown, therefore, a partition 5 comprises "partial" or "half" tiles 3 only on every other tile row 10, and, even then, primarily or exclusively on the extreme ends of the tile partition 5*a*.

FIGS. 1, 3A-3B, and 4 further show that the tiles 3, 7 can be arranged in sets of horizontal tile rows 10*a*, 10*b*, that are, in turn, only vertically-connected. That is, the tiles of each tile row 10 are connected only directly above and/or directly below (or vertically adjacent) to other tiles in a tile row 10, but not horizontally connected to other tiles in the same tile row 10. For example, FIG. 1 shows that the tiles of tile row 10*a* connect only vertically to other tiles in tile row 10*b* below (but not to other tiles in tile row 10*a*), and similarly that the tiles of tile row 10*b* connect only vertically to the next tile row below (but not to other tiles in tile row 10*b*).

In addition, FIG. 1 shows that the tile connector configurations can vary from one tile connector row 15 to the next, which provides certain rotation functions described more fully herein. For example, FIG. 1 shows that tile connector row 15*a* consists of a series of "left-handed" tile connectors 20*a* that connect tile rows 10*a* and 10*b* on a facing side of the tiles. By contrast, tile connector row 15*b* consists of "right-handed" tile connectors 20*b* that connect tile row 10*b* and the next row below on an opposing side of the tiles (i.e., rearward side in phantom view). For purposes of convenience in illustration, FIG. 1 shows rearward connectors in phantom view, while the rearward connectors in FIGS. 3A, 3B and 4 are primarily hidden.

In any case, FIG. 1 shows that both the facing/rearward attachment, as well as the right/left-handedness, of the tile connectors alternates from tile connector row 15 to tile connector row 15 throughout the partition. Of course, one will appreciate that whether any given tile connector in a sequence is left, right, facing, or rearward is arbitrary. Further along these lines, although frequent reference is made herein to connections "above" or "below" a given tile, one will appreciate that this designation is also essentially arbitrary. For example, the partition 5 of FIGS. 1, 3A-3B, and 4 can be turned on its side, depending on the type of tile connector 20 used, in which case tile rows 10 would essentially become horizontally-connected tile columns, rather than vertically connected tile rows.

In any event, FIGS. 1, 3A-3B, and 4 also show that the number of connectors 20 used per tile is effectively constant, though the number of tile connectors 20 that connect one tile to the next can depend on the type (full or half) of tile. For example, FIGS. 1, 3A-3B, and 4 show a configuration in which each tile 3, 7 comprises at least two tile connectors 20 attached at the top and at least two tile connectors 20 at the bottom for a total of at least four tile connectors 20 per tile 3, 7. FIGS. 1, 3A-3B, and 4 further show, however, that each full-tile 7 comprises only one tile connector 20 connection with another full-tile 7 above or below, while each half-tile 3 comprises at least two tile connector 20 connections to another full-tile 7 above or below.

Along these lines, FIG. 1 shows that that right-most half-tile 3 on row 10*b* connects to full-tile 7 directly above in tile row 10*a* with two different tile connectors (i.e., 20*a*). In addition, this same right-most half-tile 3 on row 10*b* connects directly below to full-tile 7 in two different places with two different tile connectors (i.e., 20*b*). Other than this exception (i.e., between half-tiles and full-tiles), each of the other illustrated full-tiles 7 in FIG. 1 connect only once (i.e., with tile connector 20*a* or *b*) to any other vertically-adjacent full-tile 7 in a next or adjacent tile row 10.

Figure 2A:
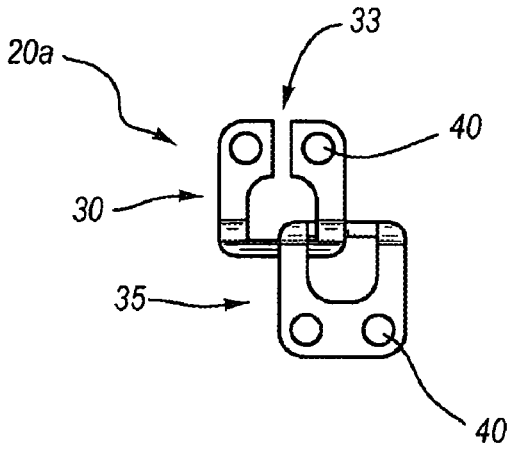
FIG. 2A illustrates a left-handed tile connector in accordance with an implementation of the present invention.
Figure 2B:
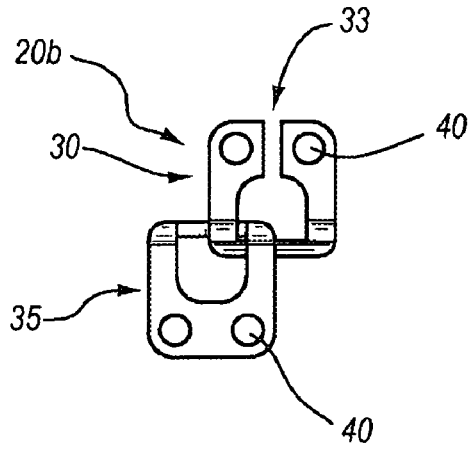
FIG. 2B illustrates a right-handed tile connector in accordance with an implementation of the present invention.

FIGS. 2A-2E illustrate additional details regarding the tile connectors 20 used to connect tiles in adjacent tile rows 10. In particular, FIG. 2A illustrates a left-handed tile connector 20*a* in accordance with an implementation of the present invention, while FIG. 2B illustrates a right-handed tile connector 20*b*. In both Figures, each tile connector 20 (left or right-handed) comprises an upper element 30 and a lower element 35 that are joined together, fastened to vertically adjacent tiles 3, 7, and thus used to hang one tile 3, 7 from another vertically adjacent tile 3, 7. As such, one will appreciate that each tile connector 20 can comprise any suitably-rigid material for holding a particular type, style, or material of tile 3, 7 with another tile 3, 7 in a hanging fashion. In one implementation, exemplary materials for the tile connector 20 can include metallic stampings of virtually any appropriate metal in addition to any sufficiently rigid resins, rubber, glass, or even wooden materials, and/or combinations thereof (including metallic combinations).

Figures 1, 2C:
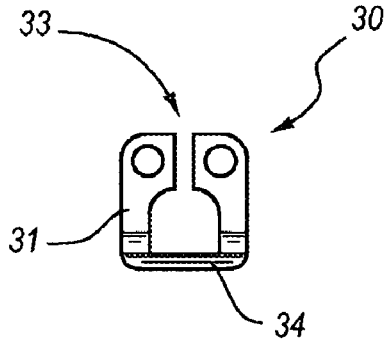

To join the two elements 30, 35 together, FIGS. 2A-2C show that the upper element 30 can be slotted (33, FIG. 2C) in conformation, so that the overall frame 31 (FIG. 2C) comprises effectively a "right" portion and a "left" portion. A manufacturer can thus insert the right or left portions of the upper element 30 into or about a hollow or perforated portion of lower element 35. In this particular example, therefore, the right or left-handedness of the given connector 20 depends on whether a manufacturer has inserted the left or right portion of the upper element 30 into the middle/hollow portion of the lower element 35. For example, FIG. 2A shows that a left-handed tile connector 20*a* comprises a lower element 35 into which a manufacturer has inserted (e.g., upwardly) the right portion of an upper element 30. By contrast, FIG. 2B shows that a right-handed tile connector 20*b* comprises a lower element 35 into which a manufacturer has inserted (e.g., upwardly) a left portion of the upper element 30.

Figures 1, 2D:
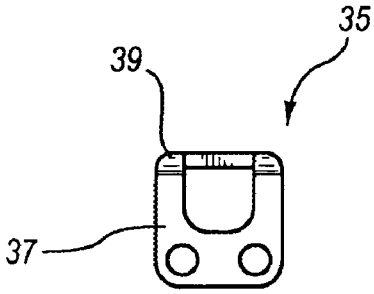
Figures 2, 2D:
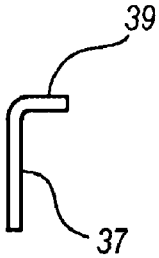

FIGS. 2C1, 2C2, 2D1, and 2D2 illustrate still additional details of the upper and lower elements 30, 35. For example, and as previously mentioned, FIG. 2C1 shows that the upper element 30 comprises a frame 31 having a slot 33 formed therein for interlocking the upper element 30 with the lower element 35. FIGS. 2C1 and 2C2 further show that the upper element 30 comprises a lower lip extension 34, which comprises a planar portion that is essentially parallel with the general plane of the main frame 31. Similarly, FIG. 2D1 shows that the lower element 35 comprises a main frame 37 as well as an essentially perpendicular extension 39. In a facing view (FIG. 2D1), the main frame 37 of lower element 35 comprises an essentially U-shaped perforation/hollow portion, which is open-ended at a point in which extension 39 deviates outwardly (e.g., FIG. 2D2) from the predominate plane/axis of the main frame 37.

In combination, therefore, one will appreciate that the lower lip extension 34 of upper element 30, and the extension 39 of lower element 35, form a complementary, rotatable attachment interface that provides the lower and/or upper elements 30, 35 with significant rotational freedom. For example, holding lower element 35 fixed in connector 20*a*, a user can rotate upper element 30 from left to right (and vice versa) about 180°. Similarly, holding lower element 35 fixed in connector 20*b*, the user can rotate upper element 30 from right to left (and vice versa) about 180°.

Figure 2E:
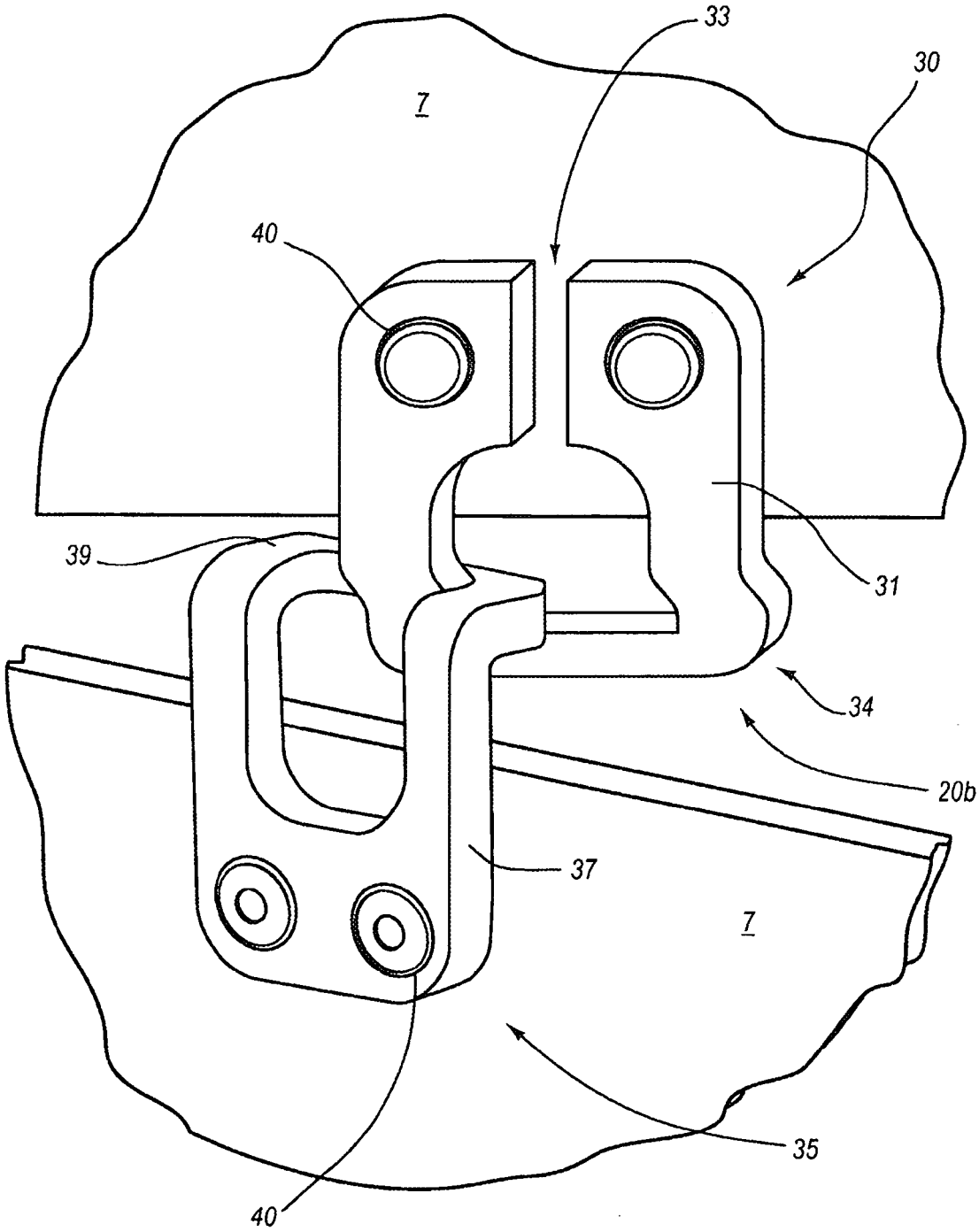
FIG. 2E illustrates a close up perspective view of a right-handed connector when connected to two opposing tiles.

Along these lines, FIG. 2E illustrates a close up view of a right-handed tile connector 20 when connected to opposing full-tiles 7 (e.g., via apertures 40, as well as corresponding fasteners such as rivets). For example, FIG. 2E shows that both the upper element 30 and lower element 35 of connector 20*b* are connected to corresponding tiles 7 and that the lower element 35 of tile connector 20*b* hangs from the upper element 30 of tile connector 20*b*. In addition, FIG. 2E shows that extensions 34 and 39 of the attachment interface complement each other in facilitating rotation of the illustrated tiles 7 relative to each other.

One will appreciate that this rotational freedom of the attachment interface can, therefore, be exploited in conjunction with the alternating configuration of tile connector rows 15 to provide the tile partition 5 with a number of benefits. As previously described, such benefits include not only positional variability of tiles, and collapsibility of the partition, but also uniformity in rotation of each tile in a tile row. For example, the above-described rotational freedom of each tile connector 20 generally ensures that each tile in each tile row 10 can be rotated in a highly variable and configurable manner from about 0° to about 180°.

In addition, the above-described alternating attachment scheme ensures that each tile in the entire partition is effectively connected (directly or indirectly) to each other tile. Thus, rotating any given tile in a tile row means that all other tiles in that tile row will rotate in the same direction. Furthermore, rotating the given tile in the tile row means that each set of full-tiles 7 in a vertically adjacent tile row will rotate in an opposing direction by a proportional amount.

More specifically, a user turns the upper left most tile 3, 7 of row 10*a*, which in turn causes the lower half-tiles 3 in tile row 10*b* to rotate an effectively proportional amount in the same direction, but otherwise causes the lower full-tiles 7 in tile row 10*b* to rotate an effectively proportional amount in an opposing direction. This rotation by tiles 3, 7 in row 10*b* further translates to rotation of the other connected tiles 3, 7 vertically above and below in row 10*a* and throughout the rest of the tile partition. As a result—and although there will be at least some give from one tile 3, 7 to the next due to rotational freedom in each tile connector 20—FIG. 3A shows that each of the full-tiles 7 are aligned in row 10*a* in an essentially parallel formation in one direction. By contrast, full-tiles 7 in the next adjacent row (e.g., 10*b*) are aligned in an essentially parallel formation in a different direction by a proportional amount. (Half-tiles 3 remain aligned in the same position as the upper or lower full-tiles 7 due to the double connection therewith). Again, such identical and/or uniform rotation from tile to tile in each given tile row 10 is done without horizontally connecting any of the tiles 3, 7 in the same tile row.

In addition, due at least in part to the rotational freedom of each tile connector 20 in partition 5, a user can angle the tiles 3, 7 so that the partition 5 has anywhere from a full, planar configuration (e.g., FIG. 1) to virtually complete compaction. This can be continued to an extreme form in which the entire partition 5 collapses. For example, FIG. 3B shows a configuration of the tile 3, 7 curtain 5*a* shown in FIGS. 1 and 3A, in which the user has oriented all of the tiles 3, 7 into a collapsed or compact state. In most cases, a user can cause this collapsed state in place, and need not necessarily move the tile partition 5 (e.g., by sliding) into another area. Accordingly, one will appreciate that the inventive tile partition 5 can be easily configured, moved, or otherwise altered from one shape to another despite even significant space constraints.

Of course, one will appreciate that the degree to which any given partition 5 can be made fully planar or fully collapsed, can depend on a number of other factors besides just the rotational capabilities of the tile connectors 20. Such additional factors that can affect partition 5 orientation/conformation can include the number or spacing of rotatable hanging apparatus 13 used to hang or mount the partition 5 on a support structure, as well as the shape of the various tiles 3, 7. For example, FIGS. 1 and 3A show that the upper-most tiles 3, 7 have one or more rotatable hanger apparatus 13 attached thereto. Such hanger apparatus 13 can comprise components as simple as a 1" split-ring (e.g., a shower curtain ring), and/or a ring that has been joined with yet one or more other rings to provide additional rotation. Such hanger apparatus 13 can also comprise a tubular member having a rotatable pin and ring configuration inside, which rotates within the tubular member, such as illustrated. In either case, the rotatable hanger apparatus 13 can hang freely, and/or are otherwise oriented to allow 180 degrees of rotation when folding.

In one implementation, the hanger apparatus 13 (and any other connection described herein) can further comprise one or more rivet structures, including stainless steel blind rivets, such as custom, stainless steel "Cherry Mate" (two part) rivets that join the hanger apparatus 13 to the tiles 3, 7. Of course, one will appreciate that the hanger apparatus 13 can be much more complex, and can include components configured to join or align the tile partition 5 with mechanized alignment means. However configured, the hanger apparatus 13 will generally include means for ensuring that the attached tiles 3, 7 can rotate a desired degree sufficient for the conformation of the overall partition 5, such that the hanger apparatus 13 provides a rotational capability of up to about 180°.

In each case, the manufacturer may implement a relatively small number of rotatable hanger apparatus 13 (i.e., one or fewer hanger apparatus 13 per tile 3, 7) that are spaced widely apart to maximize the ability of the tile partition 5 to contract or expand along the support structure. By contrast, the manufacturer may implement the hanger apparatus 13 with shorter spacing—or even randomized spacing—therebetween for aesthetic or structural effects (and difference in ability to fold/contract) even if only in portions of the partition. As previously mentioned, shorter spacing between hanger apparatus 13 will tend to constrain the ability of the partition to collapse at that point.

FIG. 4 illustrates a generalized schematic of at least another implementation of tile partition 5(*b*), which is configured with hexagonal tiles 3*a*, 7*a*, and thus shows yet another way of varying the look and feel of a partition (i.e., by varying the tiles). As with the rectangular tile partition 5*a*, however, the overall tile layout is effectively the same. In particular, FIG. 4 shows that partition 5*b* uses full hexagonal tiles throughout the tile rows, and otherwise uses half-tiles 3*a* (i.e., half-hexagonal tiles) at extreme edges of the partition 5*b* in alternating tile rows 50*a*, 50*b*. In addition, and also consistent with tile partition 5*a*, the tiles 3*a*, 7*a* (except at the extreme edges) in tile partition 5*b* are also each connected on at least two sides (e.g., top and bottom) to one or more other tiles using at least two different tile connectors 20 per top and bottom side (e.g., using right-handed and left-handed tile connectors). One will appreciate that a manufacturer can even lengthen the tile connectors or spacing between tiles (and/or even notch the tiles as needed where the connectors join the tiles) to further accommodate tile rotation.

Figure 5:
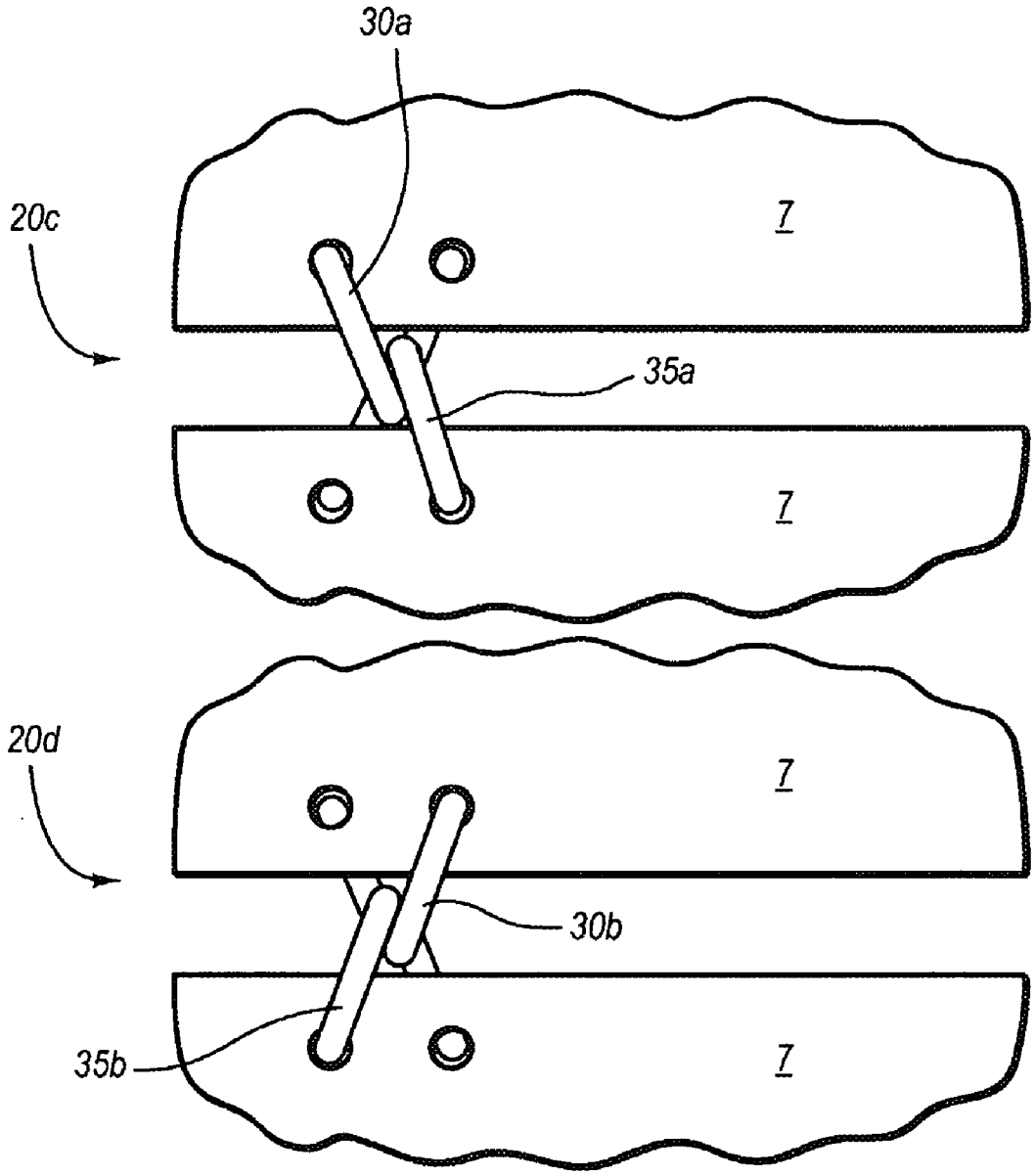
FIG. 5 illustrates a schematic drawing of one or more alternative tile connectors that can be used in accordance with an implementation of the present invention.

FIG. 5 illustrates yet another way in which the various connection/assembly apparatus described herein can be modified in accordance with the present invention. In particular, FIG. 5 illustrates an alternative implementation of tile connectors 20 otherwise shown in FIGS. 2A-2E, which, in this case incorporate ties formed in a split-ring conformation, rather than the previously illustrated stampings. Along these lines, the illustrated ties of FIG. 5 can comprise split rings (e.g., u or v-shaped) that are joined in a left- or right-handed configuration. The ends of the split rings can then be fastened through the corresponding tile 3, 7, e.g., using rivet-style connections.

For example, FIG. 5 illustrates tile connector 20*c*, which is effectively a left-handed connector (compared with connector 20*a*), and tile connector 20*d*, which is effectively a right-handed connector (compared with 20*b*). In this configuration, the upper and lower elements 30*a*, 35*a* of connector 20*c* comprise identical split rings that have been angled in a similar first conformation, and further combined in a left-handed conformation. By contrast, the upper and lower elements 30*b* and 35*b* of connector 20*d* comprise, again, identical split rings that have been angled in a similar second conformation, and further combined in a right-handed conformation. As with the tile connectors 20*a*-20*b* discussed previously, FIG. 5 shows that the manufacturer can align the tile connectors 20*c* and 20*d* on opposing sides of a given tile 3, 7, alternating by row. This alternation of left and right-handed ties/tile connectors, as well as facing or rearward orientations of ties/tile connectors per tile connector rows, enables the opposing rotation of tiles 3, 7 per each tile row, just as shown or described with tile connectors 20*a* and 20*b*.

Accordingly, FIGS. 1-5 illustrate a number of components, apparatus, and configurations for a tile partition with corresponding exemplary tiles 3, 7 and tile connectors 20 in accordance with implementations of the present invention. One will appreciate that these illustrations and corresponding descriptions are merely exemplary of the many possible apparatus, uses and configurations for a variable tile partition 5. For example, a variable tile partition in accordance with an implementation of the present invention can be used as a door, a window treatment, an optical and/or acoustic diffuser, or even simply as a decorative element.

Along these lines, a user may desire to use the variable tile partition in a setting in which optical properties and/or acoustic/sound properties in a given space may need to be varied. One will appreciate that there are a number of ways in which the tile partition described herein can be used to facilitate such diffusion on a fairly granular basis. With respect primarily to optical diffusion, for example, the tiles 3, 7 in any given partition 5 can be opaque, whereby opening and closing the tiles 3, 7 is at least one way to diffuse light passing through to another side of the partition. (This is also true for diffusing sound, though the opacity of a given tile will typically have no effect on sound blocking.)

Alternatively, at least some of the tiles 3, 7 are translucent to a degree, or otherwise are transparent but include decorative objects inside that at least partially block light. In such cases, both the relative translucence of the tiles, as well as the degree to which the tiles are opened or shut, can have an effect on the light diffusion characteristics. Furthermore, the shape of the given tiles 3, 7 may lend themselves more to blocking or passing light or sound through in various planar or angled configurations.

Accordingly, a user who desires to create variable lighting or sound effects in a given space can create/position the tile partition (and may choose specific tile shapes to enable a particular effect), and then adjust the partition to suit a particular light diffusion value. For example, one method in accordance with an implementation of the present invention includes aligning a plurality of particularly shaped tiles 3, 7 in a tile row 10 (e.g., 10*a*). The method also includes vertically connecting a plurality of tiles 3, 7 in a next row 10 (e.g., 10*b*) to the tile row 10 with at least two tile connectors per tile 3, 7 on one of a facing or rearward side.

In addition, this method can include vertically connecting a plurality of tiles 3, 7 in a further row 10 to the next tile row 10 with at least two tile connectors per tile 3, 7 on the other of the facing or rearward sides. Furthermore, the method can include aligning one of the plurality of tiles 3, 7 in any of the tile rows 10 by an amount in a direction. As previously described, this will mean that at least some of the other tiles 3, 7 automatically change orientation in the same direction, and at least some (e.g., the remainder) of the tiles change in an opposing direction proportional to the amount (e.g., FIG. 3A).

With respect to the above-mentioned optical characteristics, the method can further include positioning the variable partition on one side of a light or sound/acoustic source, and identifying a desired lighting or sound value on a side (e.g., of the variable partition opposite the light/sound source). The user can then align one of the tiles 3, 7 in accordance with the desired lighting/sound value, whereby the amount of alignment of the one tile 3, 7 causes the entire variable partition 5 to diffuse light/sound projected by the light/sound source, and thereby create the desired lighting/sound value on the opposing side. Of course, light/sound can also be diffused on the same side as the light/sound source.

For example, the partition(s) 5 in accordance with an implementation of the present invention can be particularly suited as treatments to walls or ceilings in an arena (e.g., concert room/hall) where certain acoustic effects are desired. As with the description above, the user can align each partition 5 where appropriate adjacent each wall or ceiling, and then rotate one or more of the tiles 3, 7 by a determined amount that corresponds to a particularly determined acoustic diffusion value. An advantage of the present invention, therefore, is that, if any particular tile 3, 7 adjustment fails to achieve the appropriate diffusion values, a user can easily adjust any one or more of the tiles 3, 7 in the partition 5 until such desired sound/acoustic/optical diffusion properties are met with the entire partition.

Accordingly, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A decorative partition with variable-angle tiles for use in partitioning an interior or exterior space, and/or for decorating a window, wall, floor, or ceiling structure, comprising:

a plurality of tiles aligned in a plurality of different tile rows, wherein each tile in each tile row is connected by a plurality of rotatable tile connectors to one or more tiles in a vertically adjacent tile row of the plurality of tile rows;

wherein:

tiles in at least one tile row are configured to rotate in the same direction upon rotation of any particular tile in the partition;

tiles in the vertically adjacent tile row above or below the at least one tile row are configured to rotate in an opposing direction upon rotation of the tiles in the at least one tile row;

the rotatable tile connectors comprise an upper element and a lower element that are each fastened only to an upper tile or a lower tile, respectively;

the upper element comprises a slotted frame configured to insert into a perforated portion of the lower element; and the lower element hangs from the slotted frame of the upper element.

2. The tile partition as recited in claim 1, wherein the plurality of tiles in each of the plurality of tile rows comprise a translucent polymeric resin material.

3. The tile partition as recited in claim 1, wherein each of the plurality of tiles comprises one of a full- or half-tile.

4. The tile partition as recited in claim 3, wherein at least one of the plurality of tile rows comprises a set of full-tiles, and each next adjacent tile row comprises both full and half-tiles of the shape.

5. The tile partition as recited in claim 4, wherein the plurality of tile rows are aligned in a staggered formation, such that each full-tile in any of the plurality of tile rows overlaps with at least two tiles in the next adjacent tile row.

6. The tile partition as recited in claim 4, wherein each of the half and full-tiles comprise a full or partial version of the same shape.

7. The tile partition as recited in claim 6, wherein the shape of the full-tiles comprise a rectangular shape, and wherein the half-tiles comprise a half-rectangular shape.

8. The tile partition as recited in claim 6, wherein the shape of the full-tiles comprise a hexagonal shape, and wherein the half-tiles comprise a half-hexagonal shape.

9. The tile partition as recited in claim 1, further comprising a plurality of right-handed and left-handed tile connectors that connect directly adjacent tile rows, wherein:

right-handed tile connectors are connecters where the upper element is configured to rotate counter-clockwise from a default, planar configuration and the lower element is configured to rotate clockwise from the default, planar configuration; and left-handed tile connectors are connecters where the upper element is configured to rotate clockwise from a default, planar configuration and the lower element is configured to rotate counter-clockwise from the default, planar configuration.

10. The tile partition as recited in claim 9, wherein vertically adjacent tile rows are connected together only with all left-handed or all right-handed tile connectors.

11. The tile partition as recited in claim 9, wherein:

all right-handed tile connectors connect adjacent tile rows on a facing side of each tile; and all left-handed tile connectors connect adjacent tile rows on an opposing side of each tile, such that each tile connector row alternates both in facing or rearward alignment and in right or left-handed configuration from one tile connector row to the next.

12. A decorative partition with variable-angle tiles for use in partitioning an interior or exterior space, and/or for decorating a window, wall, floor, or ceiling structure, comprising:

a row of decorative tiles of one or more shapes;

an adjacent row of decorative tiles of one or more shapes, the adjacent row of decorative tiles being connected to the row of decorative tiles with a set of rotatable tile connectors; and a next row of decorative tiles of one or more shapes, the next row of decorative tiles being connected to the adjacent row of decorative tiles with a set of rotatable tile connectors;

wherein each tile in the partition is connected either directly or indirectly to each other tile so that rotation of any tile in the partition causes a proportional rotation in at least some of the tiles in the partition in one direction, and the remainder of the tiles in the partition in an opposing direction;

wherein:

the rotatable tile connectors comprise an upper element and a lower element that are each fastened only to an upper tile or a lower tile, respectively;

the upper element comprises a slotted frame configured to insert into a perforated portion of the lower element; and the lower element hangs from the slotted frame of the upper element.

13. The variable-angle tile partition as recited in claim 12, wherein each tile in the partition is only connected vertically above or below to another tile in the partition.

14. The variable-angle tile partition as recited in claim 12, wherein the rotatable tile connectors are configured as one of a left-handed tile connector or a right-handed tile connector, wherein:

right-handed tile connectors are connecters where the upper element is configured to rotate counter-clockwise from a default, planar configuration and the lower element is configured to rotate clockwise from the default, planar configuration; and left-handed tile connectors are connecters where the upper element is configured to rotate clockwise from a default, planar configuration and the lower element is configured to rotate counter-clockwise from the default, planar configuration.

15. The variable-angle tile partition as recited in claim 14, wherein vertically adjacent tile rows are connected together only with all left-handed or all right-handed tile connectors.

16. The variable-angle tile partition as recited in claim 14, wherein:

all right-handed tile connectors connect adjacent tile rows on a facing side of each tile; and all left-handed tile connectors connect adjacent tile rows on an opposing side of each tile, such that each tile connector row alternates both in facing or rearward alignment and in right or left-handed configuration from one tile connector row to the next.

17. The variable-angle tile partition as recited in claim 14, wherein:

the upper element and the lower element comprise corresponding extensions; and the corresponding extensions of the upper and lower elements combine to form an attachment interface that is rotatable up to about 180°.

18. A method of providing a variable barrier or partition to an interior space with variable light or sound diffusion characteristics, comprising:

aligning a plurality of tiles in a tile row;

vertically connecting a plurality of tiles in a next row to the tile row with at least two tile connectors per tile on one of a facing or rearward side by securing an upper element having a slotted frame to each tile in the tile row, inserting the slotted frame of each upper element into a perforated portion of a lower element, and connecting each lower element to a tile of the next tile row such that each lower element hangs from a slotted frame of an upper element;

vertically connecting a plurality of tiles in a further row to the next row with at least two tile connectors per tile on the other of the facing or rearward sides; and aligning one of the plurality of tiles in any of the tile rows by an amount in a direction, wherein each of the other tiles automatically changes its direction in one of the same or an opposing direction proportional to the amount.

19. The method as recited in claim 18, wherein the plurality of tiles in one or more of the tile rows are translucent, the method further comprising:

positioning the variable partition on one side of a light source; and identifying a desired lighting value on an opposing side of the variable partition;

aligning the one tile in accordance with the desired lighting value;

wherein the amount of alignment of the one tile causes the entire variable partition to diffuse light projected by the light source, and thereby create the desired lighting value on the opposing side.

20. The method as recited in claim 18, further comprising:

positioning the variable partition on one side of an audio source;

identifying a desired audio value on an opposing side of the variable partition; and aligning the one tile in accordance with the desired audio value;

wherein the amount of alignment of the one tile causes the entire variable partition to diffuse sound projected by the audio source, and thereby create the desired audio value on the opposing side.

* * * * *